United States Patent [19]

Gatzke

[11] 4,394,433

[45] Jul. 19, 1983

[54] DIAZONIUM IMAGING SYSTEM

[75] Inventor: Kenneth G. Gatzke, Lake Elmo, Minn.

[73] Assignee: Minnesota Mining and Manufacturing Company, St. Paul, Minn.

[21] Appl. No.: 286,197

[22] Filed: Jul. 23, 1981

Related U.S. Application Data

[63] Continuation-in-part of Ser. No. 101,143, Dec. 7, 1979, abandoned.

[51] Int. Cl.[3] ..... G03C 1/60; G03C 5/18; G03C 1/727

[52] U.S. Cl. ..... 430/151; 430/154; 430/157; 430/176; 430/177; 430/179; 430/334; 430/336; 430/338; 430/340; 430/341; 430/343

[58] Field of Search ..... 430/151, 152, 154, 157, 430/177, 179, 334, 336, 338, 343, 292, 293, 340, 341; 250/316.1, 317.1; 427/150; 428/411

[56] References Cited

U.S. PATENT DOCUMENTS

| | | | |
|---|---|---|---|
| 2,855,303 | 10/1958 | Chalkley | 430/332 |
| 3,032,414 | 5/1962 | James et al. | 430/152 |
| 3,215,529 | 11/1965 | Lindquist et al. | 96/27 |
| 3,390,997 | 7/1968 | Read | 96/48 |
| 3,445,233 | 5/1969 | Cescon | 96/90 |

FOREIGN PATENT DOCUMENTS

| | | |
|---|---|---|
| 51-51942 | 5/1976 | Japan . |
| 53-102038 | 9/1978 | Japan . |
| 1041463 | 4/1963 | United Kingdom . |
| 1170458 | 2/1967 | United Kingdom . |

OTHER PUBLICATIONS

Mees and James, "The Theory of the Photographic Process, " 3rd Ed., Macmillion Co., 283–284, 390–391.

Kosar, "Light-Sensitive Systems," Wiley and Sons, Inc., 1965, 367, 370–380, 406.

P. Glafkides, "Photographic Chemistry," Fountain Press, vol. II, 709–725.

*Primary Examiner*—Charles L. Bowers, Jr.

*Attorney, Agent, or Firm*—Cruzan Alexander; Donald M. Sell; Lorraine R. Sherman

[57] ABSTRACT

A novel light sensitive, heat developable imaging system incorporating a diazonium salt and a leuco dye in a binder is disclosed.

18 Claims, No Drawings

DIAZONIUM IMAGING SYSTEM

This is a continuation-in-part of application U.S. Ser. No. 101,143, filed Dec. 7, 1979, now abandoned.

TECHNICAL FIELD

A novel light sensitive, heat developable imaging system incorporating a diazonium salt and a leuco dye in a binder is disclosed. The system is useful, for example, as a microfilm duplicating sheet or a heat sensitive recording material.

BACKGROUND ART

U.S. Pat. No. 3,390,997 discloses a light-sensitive admixture of an alkylthio, benzylthio, 2-phenylhydrazino or alkoxycarbonyl derivative of a triphenylmethane compound (a "leuco dye") and a selected nonvolatile nitrogen-containing compound which functions as a photooxidant useful as an imaging system. The patent does not disclose the use of diazonium salts or materials which contain a pentavalent nitrogen atom. The light sensitive compounds of the present invention differ significantly from those of the patent which contain only trivalent nitrogen atoms. Furthermore, the present invention requires elevated temperatures (180° F. [82° C.] to 380° F. [193° C.]) for image development, whereas the patent disclosure is of a room temperature developing system.

U.S. Pat. Nos. 3,445,233 and 3,215,529, and Abstracts of Japanese Pat. No. 78-102,038 and Japanese Document No. 51-51942 disclose imaging systems containing diazonium salts but in no case do they react directly with leuco dyes. Great Britain patent specification Nos. 1,041,463 and 1,170,458 disclose diazonium salts interacting with acid-base indicators.

An imaging system comprising a leuco dye, a diazonium salt, and nitrate ion in a binder is described in assignee's now allowed copending continuation-in-part patent application, U.S. Ser. No. 200,323, filed Oct. 24, 1980, the parent of which is U.S. Ser. No. 101,196 filed Dec. 7, 1979, now abandoned. This four-part imaging system does not suggest the efficacy of the three-part imaging system of the present invention, and the chemical mechanisms in these diverse systems is believed to be different.

DISCLOSURE OF THE INVENTION

The present invention relates to a light sensitive, heat developable imaging system comprising a polymeric binder resin, a leuco dye, and a diazonium salt. In the practice of the present invention the chemical nature of the polymer including its acid content has not been found to be a functional requirement.

Furthermore, no oxidizing anion, including nitrate ion, is a necessary component of the present invention as it is in assignee's copending application mentioned above. If any nitrate ion is present, it is in amounts of less than 0.1 mole nitrate/1.0 mole dye. Other oxidizing anions and compounds may be present in greater or lesser amounts, but are not essential in the practice of the present invention.

In the present invention, the leuco dye (a clear to faintly colored material), the diazonium salt and the polymeric binder resin are incorporated in a solvent system and cast on any substrate such as paper, polymeric film such as polyester, glass, metal, ceramics and the like. Upon irradiation by light, the diazonium salt is destroyed. The subsequent application of heat to the coating results in oxidation of the leuco dye by the diazonium salt to a colored form in the non-light struck portion of the coating. A positive-acting image is thus produced since color is generated where no light has contacted the coating.

DETAILED DESCRIPTION OF THE INVENTION

The present invention relates to a light sensitive, heat developable layer comprising a polymeric binder, a leuco dye, and a photosensitive diazonium salt. These ingredients are preferably in a homogeneous or molecular mixture with each other.

The Binder

Any natural or synthetic polymeric binder may be used in the practice of the present invention. Organic polymeric resins, preferably thermoplastic resins (although thermoset resins may be used), are generally preferred. The most preferred resins are polyvinyl acetate and polyvinyl chloride copolymers. Such resins as polyvinyl acetals, polyesters, polyvinyl resins, polyvinylpyrrolidone, polycarbonates, polyamides, polyvinyl butyral, polyacrylates, cellulose esters, copolymers and blends of these classes of resins, and others have been used with particular success. Natural polymeric materials such as gelatin and gum arabic may also be used. Where the proportions and activities of the leuco dye and diazonium salt require a particular developing time and temperature, the resin should be able to withstand those conditions. Generally it is preferred that the polymer not decompose or lose its structural integrity at 300° F. (147° C.) for 60 seconds and most preferred that it not decompose or lose its structural integrity at 380° F. (193° C.) for 5 minutes. Also, polymers must be compatible with the other components and solvents, in addition to having a reasonably low softening point for processability. Such polymers desirably are permeable to trapped gases.

In addition to these requirements, the selected binder must be transparent or translucent and be either clear or lightly colored. This will ensure an obvious contrast with colored areas (non-light struck) after heat development.

The binder may serve a number of additionally important purposes in the constructions of the present invention. The imageable materials may be protected from ambient conditions such as moisture. The consistency of the coating and its image quality are improved. The durability of the final image is also significantly improved. The binder should be present as at least 25% by weight of ingredients in the layer, more preferably as at least 50% by weight and most preferably as at least 70% by weight of dry ingredients (i.e., excluding solvents in the layer).

Dyes

Leuco dyes are well known in the art. These are colorless or lightly colored dyes which when subjected to an oxidation reaction form a colored dye. These leuco dyes are described in the literature (e.g., *The Theory of the Photographic Process,* 3rd Ed., Mees and James, pp 283–4, 390–1, Macmillion Co., N.Y.; and *Light-Sensitive Systems,* Kosar, pp. 367, 370–380, 406 (1965) Wiley and Sons, Inc., N.Y.). Amongst the best known leuco dyes are leuco crystal violet (LCV) and leuco malachite green (LMG). Only those leuco dyes which can be converted to colored dyes by oxidation are useful in the practice of the present invention. Acid or base sensitive dyes such as phenolphthalein and other indicator dyes are not useful in the present invention unless they are also oxidizable to a colored state. Indicator dyes would only form transient images or would be too sensitive to changes in the environment. The dyes which have been specifically shown to work in the present invention are discussed in detail below and include but are not limited to the following:

| | |
|---|---|
| Leuco Crystal Violet | Leuco Ethyl Violet |
| Leuco Malechite Green | Leuco Victoria Blue-BGO |
| Copichem II | Leuco Atacryl Yellow-R |
| Leuco Atacryl Orange-LGM | Leuco Atlantic Fuchsine Crude |
| Leuco Atacryl Brilliant Red-4G | |

The leuco dyes of the present invention become colored due to oxidation, that is, they have absorbance after coloration in the visible portion of the electromagnetic spectrum (approximately 400 to 700 nm). The leuco dye should be present as at least about 0.3% by weight of the binder layer, preferably at least 1% by weight, and most preferably at least 2% to 10% or more by weight of the dry weight of the imageable layer.

In forming the leuco dye layer or coating of the dye layer onto a substrate, temperatures should, of course, not be used during manufacture which would colorize the layer or decompose the diazonium salts. Some slight colorization is tolerable, with the initial leuco dye concentrations chosen so as to allow for anticipated colorization. It is preferred, however, that little or no leuco dye be colorized during forming or coating so that more standardized layers can be formed. Depending on the anticipated development temperature, the coating or forming temperature can be varied. Therefore, if the anticipated development temperature were, for example, 350° F. (167° C.), the drying temperature could be 280° F. (138° C.), and it would not be desirable for the layer to gain 20% of its optical density at the drying temperature in less than 4–5 minutes. Such a gain would be tolerable by correspondingly increasing the amount of leuco dye.

There should be sufficient colorizable dye present in the colorizable layer of the present invention to provide an increase in optical density upon development of at least 0.2, more preferably 0.6, and most preferably 1.0 or greater. These increases can be measured at the development temperatures for the imaging materials, e.g., 270° F. (132° C.) for 60 seconds. Thus the preferred limitation of at least 0.2 gain in optical density or absorbance of colorless light at 270° F. (132° C.) for 60 seconds is based on the assumption of a development temperature of 270° F. (132° C.). For an anticipated higher or lower development temperature, the 0.2 gain in optical density or absorbance should occur at that development temperature within a reasonable period of time. A reasonable development temperature range is between 180° F. (82° C.) and 380° F. (193° C.) and a reasonable dwell time is between 5 seconds and 5 minutes, preferably at between 220° F. (105° C.) and 350° F. (167° C.) and for 10 to 180 seconds, with the longer times most likely associated with the lower development temperatures. Therefore, all of the absorbance characteristics are applicable to the generally useful development range of 180° F. (82° C.) to 380° F. (193° C.).

Diazonium Salts

Light sensitive diazonium salts are well known in the art. These salts comprise a light sensitive aromatic nucleus with an external diazonium group and an anion associated therewith (e.g., *Light-Sensitive System*, Kosar, pp. 202–214, John Wiley and Sons, Inc. 1965, N.Y.; and *Photographic Chemistry*, Vol. II, P. Glafkides, pp. 709–725, Fountain Press, London). They may be generally represented by the formula:

$$ArN^{+}\equiv NX^{-}$$

wherein

Ar is an aromatic nucleus, and $X^-$ is an anion.

Any anion may be used in the diazonium salt. Anions as diverse as zinc chloride, tri-isopropyl naphthalene sulfonate, fluoroborate (i.e., $BF_4^-$), and bis(perfluoroalkylsulfonyl)methides may be used. The change in anions may affect the speed of the imaging layer, but not its function. Any light sensitive aromatic diazonium nucleus, as known in the art, may also be used in the practice of the present invention. These diazonium nuclei, particularly those belonging to the classes pyrrolidine, morpholine, aniline, and diphenyl amine and its polymers are well known in the art and include, for example, P-anilinobenzene; N-(4-diazo-2,4-dimethoxy phenyl)-pyrrolidine; 1-diazo-2,4-diethoxy-4-morpholino benzene; 1-diazo-4-benzoyl amino-2,5-diethoxy benzene; 4-diazo-2,5-dibutoxy phenyl morpholino; 4-diazo-1-dimethyl aniline; 1-diazo-N,N-dimethyl aniline; 1-diazo-4-N-methyl-N-hydroxyethyl aniline; etc.

Additives

Other materials which may be useful in the formulations of the present invention include reducers and complexors, plasticizers and polyketones, stablizers, surfactants, antistatic agents, coating aids, oxidizing materials (other than nitrate ion which may be present only in amounts less than 0.1 mole nitrate to 1.0 mole dye), inhibitors, lubricants, flexibilizers, fillers and the like.

All of this will be more thoroughly understood by consideration of the following examples. All examples were prepared and processed using the method described under Example 1–11.

EXAMPLES 1–11

These examples examine the effect of using different binders in the formulation. Two separate solutions, A and B, were prepared. Solution A comprised 0.020 g phthalic acid, 0.010 g catechol, 0.10 g Phenidone A (1-phenyl-3-pyrazolidone), 0.200 g aromatic ketone resin, 0.200 g polymeric plasticizer (ter,2,4-trimethylpentane,1,3-diol adipate 2-ethylhexanol terminated [900–1100 molecular weight]) and 1.060 g methyl ethyl ketone (MEK) for a total weight of 1.5 g. Solution B comprised 0.051 g. leuco crystal violet (4,4',4''-methylidynetris-(N,N-dimethylaniline), 0.046 g. leuco malachite green (p,p'-benzylidenebis-(N,N-dimethylaniline)), and 1.429 g. tetrahydrofuran (THF), for a total weight of 1.5 g. 1.5 g of each of solutions A and B were mixed with 0.1 g 1-diazo-2,5-diethoxy-4-morpholino benzene borofluoride (DDMBB) and in each case with the stated amount(s) of binder(s), (see Table I), to form a solution which was then coated on polyethylene terephthalate film to a thickness as noted in the table. The coated film was dried at 160° F. (71° C.), exposed to a mercury vapor lamp for $10^6$ meter-candle-seconds, and then developed for 60 seconds at 270° F. (132° C.). The optical densities in the light struck (LS) areas, also referred to as Dmin, and the non-light struck (NLS) areas, also referred to as Dmax, are recorded in Table I.

Phthalic acid is useful in these formulations to stabilize the coating solution by preventing the diazonium salt from reacting before development.

TABLE I

| Example | Binder(s) | Weight(g) | Thickness(mils) | LS (Dmin) | NLS (Dmax) |
|---|---|---|---|---|---|
| 1 | 35% VC-VA-VAL-91/3/5.7[a]<br>32.5% tetrahydrofuran<br>32.5% methyl ethyl ketone | 1.7 | | | |
| | | | — | incompatible | |
| | 35% PR-OS[b]<br>32.5% tetrahydrofuran<br>32.5% methyl ethyl ketone | 1.7 | | | |
| 2 | 35% VC-VA-VAL-91/3/5.7[a]<br>32.5% tetrahydrofuran<br>32.5% methyl ethyl ketone | 2.4 | 2.6 | .34 | .90 |
| 3 | 35% PR-OS[b]<br>32.5% tetrahydrofuran<br>32.5% methyl ethyl ketone | 2.4 | 2.6 | .20 | .58 |
| 4 | 15% CA-BR[c]<br>10% methyl isobutyl ketone (MIBK)<br>20% ethanol<br>55% acetone | 8.0 | 4.4 | .20 | .80 |
| 5 | 15% CA-BR[d]<br>10% methyl isobutyl ketone<br>20% ethanol<br>55% acetone | 8.0 | 4.4 | .22 | .73 |
| 6 | 35% VC-VA-87/13-1[e]<br>15% methyl isobutyl ketone<br>50% methyl ethyl ketone | 3.4 | 2.6 | .27 | 1.08 |
| 7 | 15% BR-AS[f]<br>10% methyl isobutyl ketone<br>20% methanol<br>55% acetone | 8.0 | 4.4 | .20 | .75 |
| 8 | 20% CAR[g]<br>20% methanol<br>10% methyl isobutyl ketone<br>50% acetone | 6.0 | 3.6 | .23 | .70 |
| 9 | 15% PVBR[h]<br>10% methyl isobutyl ketone<br>30% ethanol<br>45% methyl ethyl ketone | 8.0 | 4.4 | .25 | .71 |
| 10 | 15% PVBR[i]<br>10% methyl isobutyl ketone<br>20% ethanol<br>55% methyl ethyl ketone | 8.0 | 4.4 | .22 | .55 |
| 11 | 25% VC-VA-VAL-91/3/5.7[a]<br>37.5% methyl isobutyl ketone<br>37.5% methyl ethyl ketone | 4.8 | 3.2 | .38 | 1.05 |

[a]vinyl chloride vinyl acetate vinyl alcohol (91%/3%/5.7%) terpolymer
[b]polyester resin - organic soluble
[c]cellulose acetate butyrate resin (Eastman 272-20)
[d]cellulose acetate butyrate resin (Eastman 171-25)
[e]vinyl chloride vinyl acetate (87%/13%) copolymer
[f]butyrate resin - alcohol soluble
[g]cellulose acetate resin
[h]polyvinyl butyrol resin (average molecular weight 180,000–270,000)
[i]polyvinyl butyrol resin (average molecular weight 45,000–50,000)

The change in optical density (ΔDensity), i.e., Dmax-Dmin, is of great significance and values in excess of 1.0 are of commercial practicability. Examples 6 and 11 show the greatest changes in optical density (Dmax-Dmin) between light struck and non-light struck areas.

It appears, therefore, that vinyl acetate and vinyl chloride copolymers, VC-VA-87/13-1 and VC-VA-VAL-91/3/5.7, are the preferred resins in the practice of this invention.

EXAMPLES 12–19

These examples further investigate vinyl chloride and vinyl acetate binders. The reference solution (1.5 g each of solutions A and B, and 0.1 g DDMBB) was prepared and mixed with the stated amount of binder (Table 2), then coated and treated as in examples 1–11. Results appear below.

TABLE 2

| Example | Binder | Weight(g) | Thickness(mils) | LS (Dmin) | NLS (Dmax) | ΔDensity |
|---|---|---|---|---|---|---|
| 12 | 35% VC-VA-86/14[j]<br>15% methyl isobutyl ketone<br>50% methyl ethyl ketone | 3.4 | 2.6 | .25 | .95 | .70 |
| 13 | 35% VC-VA-87/13-1[e]<br>15% methyl isobutyl ketone<br>50% methyl ethyl ketone | 3.4 | 2.6 | .26 | 1.00 | .74 |
| 14 | 35% VC-VA-87/13-2[k] | | | | | |

TABLE 2-continued

| Example | Binder | Weight(g) | Thickness(mils) | (Dmin) | LS (Dmax) | NLS ΔDensity |
|---|---|---|---|---|---|---|
| | 15% methyl isobutyl ketone<br>50% methyl ethyl ketone | 3.4 | 2.6 | .30 | 1.18 | .88 |
| 15 | 35% VC-VA-MA-86/13/1[l] | | | | | |
| | 15% methyl isobutyl ketone<br>50% methyl ethyl ketone | 3.4 | 2.6 | .27 | .95 | .68 |
| 16 | 35% VC-VA-MA-84/15/,8[m] | | | | | |
| | 15% methyl isobutyl ketone<br>50% methyl ethyl ketone | 3.4 | 2.6 | .30 | .97 | .67 |
| 17 | 35% VC-VA-VAL-91/3/5.7[a] | | | | | |
| | 15% methyl isobutyl ketone<br>50% methyl ethyl ketone | 3.4 | 2.6 | .35 | 1.20 | .85 |
| 18 | 35% VC-VA-90/10[n] | | | | | |
| | 7.5% methyl isobutyl ketone<br>25% methyl ethyl ketone<br>32.5% tetrahydrofuran | 3.4 | 2.6 | .31 | 1.13 | .82 |
| 19 | 15% CA-BR[c] | | | | | |
| | 10% methyl isobutyl ketone<br>20% ethanol<br>55% acetone | 4.0 | — | | incompatible | |

[j]vinyl chloride vinyl acetate (86%/14%) copolymer
[k]vinyl chloride vinyl acetate (87%/13%) copolymer-lower molecular weight than "e"
[l]vinyl chloride vinyl acetate maleic acid (86%/13%/1%) terpolymer
[m]vinyl chloride vinyl acetate maleic acid 84%/15%/.8%) terpolymer
[n]vinyl chloride vinyl acetate (90%/10%) copolymer.

The binders of examples 12, 13 and 14 decrease progressively in molecular weight which correlates with a progressive decrease in softening points of these resins. It is of note that the ΔDensity increases as the softening temperature of the resin decreases, reflecting better reacting conditions in softer resins.

The binders of examples 15 and 16 are resins with acid content, a factor which did not enhance the ΔDensity.

The resins of example 14 (lower molecular weight) and example 17 (hydrolyzed) provided the best ΔDensity of those tested in this group.

EXAMPLES 20–33

The following acids and a control were screened with the resin of example 14 (VC-VA 87/13-2) using in each case 0.1 g DDMBB and 4.0 g of a master batch solution comprising 2.0 g LCV, 18.0 g toluene and a solution containing 60.0 g of 40% VC-VA-87/13-2, 18% MIBK, 18% ethanol and 24% MEK:

| Example | |
|---|---|
| 20 | no acid |
| 21 | phthalic acid |
| 22 | 4-methylphthalic acid |
| 23 | citric acid |
| 24 | 3-nitrophthalic acid |
| 25 | 5-sulfosalicylic acid |
| 26 | oxalic acid |
| 27 | glutaric acid |
| 28 | benzoic acid |
| 29 | 2-naphthoic acid |
| 30 | acetic acid |
| 31 | nitric acid |
| 32 | hydrochloric acid |
| 33 | toluene sulfonic acid |

Although the most common effect appeared to be a reduction in both optical densities, Dmin and Dmax, the opposite was also true in some cases. Only nitric acid appeared to increase the maximum density and reduce the minimum density by stabilizing the diazo and also aiding in the oxidation of the leuco dye. This is an example of the effect of nitrate ion in the formulation and is the subject of assignee's copending application mentioned above. In sum, the non-nitrate acid content of the formulation has not been found to be a significant factor in the practice of this invention.

EXAMPLES 34–52

In a search for materials which would lower the Dmin and increase the Dmax, tests were performed on the addition of small amounts (0.05 g) of various reducers and complexors (antioxidants or chelating agents) in a solution of 0.01 g DDMBB and 0.85 g 1:1 methanol and acetone added to portions of a master batch comprising 2.2 g leuco crystal violet, 19.8 g toluene and 66.0 g. of a solution containing 40% VC-VA-87/13-2, 10% methyl isobutyl ketone, and 50% methyl ethyl ketone. The materials tested were:

| Example | |
|---|---|
| 34 | phenyl mercapto tetrazole |
| 35 | hydantoin |
| 36 | phthalazine |
| 37 | tetrachlorophthalic anhydride |
| 38 | Phenidone A |
| 39 | catechol |
| 40 | phthalazinone |
| 41 | phthalimide |
| 42 | benzotriazole |
| 43 | 2-mercaptobenzothiazole |
| 44 | 2-ethyl imidazole |
| 45 | thiourea |
| 46 | 2-thiohydantoin |
| 47 | 2,4,4-trimethylpentyl-bis-(2-hydroxy-3,5-dimethyl-phenyl)methane |
| 48 | 2,2'-methylenebis(4-methyl-6-tert butylphenol) |
| 49 | 2,6-bis(2'-hydroxy-3'-tert butyl-5'-methyl-benzyl)-4-methylphenol |
| 50 | 1,1,3-trimethyl-5-carboxyl-3-(p-carboxylphenyl)-indan |
| 51 | 2,6-dichloro-4-benzenesulfonamido phenol |
| 52 | ascorbic acid |

Tetrachlorophthalic anhydride, 2,4,4-trimethylpentyl-bis(2-hydroxy-3,5-dimethylphenyl)methane (TBHDM), 2,6-bis(2'-hydroxy-3'-tert butyl-5'-methyl benzyl)-4-methylphenol, and 2,2'-methylenebis(4-methyl-6-tert butylphenol) showed some degree of usefulness in increasing the ΔDensity compared to experiments without these materials. Phenidone A (1-phenyl-3-pyrazolidone) and ascorbic acid greatly depressed both the Dmin and Dmax values and when studied at lower levels of concentration (0.01 g) were found to be useful in depressing the Dmin.

EXAMPLES 53–68

Small amounts of various polyketones, plasticizers, metal salts, and benzoyl peroxide were screened for their possible effect in lowering the softening point of the resin using 4 g. of a master batch solution comprising 2.0 g leuco crystal violet, 18.0 g toluene, and 60.0 g of a solution containing 40% VC-VA-87/13-2, 18% methyl isobutyl ketone, 18% ethanol, and 24% methyl ethyl ketone. 0.1 g DDMBB dissolved in less than 1.0 g of 1:1 methyl alcohol and acetone was added. The materials tested were:

| Example | |
|---|---|
| 53 | $Mg(ClO_4)_2$, 0.05g |
| 54 | $MgBr_2.6H_2O$, 0.05g |
| 55 | $MgSO_4.7H_2O$, 0.05g |
| 56 | $Mg(NO_3)_2.6H_2O$, 0.05g |
| 57 | $MgCl_2.6H_2O$, 0.05g |
| 58 | benzoyl peroxide, 0.05g |
| 59 | aromatic polyketone resin (Mohawk Industries (MR-85), 0.20g |
| 60 | polyketone resin, softening point 200–220° F. (Union Carbide Bakelite 251), 0.2g |
| 61 | polyketone resin, softening point 165–185° F. (Union Carbide Bakelite 252), 0.2g |
| 62 | polymeric plasticizer (ter, 2,4-trimethylpentane, 1,3-diol adipate 2-ethylhexanol terminated [900–1100 molecular weight]); 0.2g |
| 63 | Eastman PA-3 (Eastman proprietary product), 0.2g |
| 64 | triethylene glycol di-2-ethylhexoate, 0.2g |
| 65 | dimethyl cellosolve phthalate, 0.2g |
| 66 | ascorbic acid, 0.01g |
| 67 | Phenidone A, 0.01g |
| 68 | control (no additive) |

The results of these tests showed no dramatic improvement in ΔDensity. It was found that plasticizers and polyketones effectively lower the softening point of the polymeric binder, thereby increasing the rate of development. They have been found to be most effective in the higher softening resins (i.e. resins of higher molecular weight) as might be expected.

EXAMPLES 69–97

These examples tested the effect of variations in the diazonium salts. Using 4 g. of the same master batch just described a study was made of the effect of the following 29 diazonium salts on the ΔDensity, 0.1 g diazonium salt being dissolved in 0.9 g of a solution of 50% methanol and 50% acetone.

| Example | |
|---|---|
| 69 | 1-diazo-3-methyl-4-pyrrolidino benzene zinc chloride |
| 70 | N—(4-diazo-2,5-dimethoxy phenyl)pyrrolidine borofluoride |
| 71 | N—(4-diazo-2,5-diethoxy phenyl)pyrrolidine borofluoride |
| 72 | 3-methyl-4-pyrrolidino benzene diazonium fluoroborate |
| 73 | 3-methoxy-4-pyrrolidino benzene diazonium fluoroborate |
| 74 | 1-diazo-3-methyl-4-pyrrolidino benzene chloride zinc chloride |
| 75 | 1-diazo-3-methyl-4-pyrrolidino benzene chloride fluoroborate |
| 76 | 1-diazo-4-morpholino benzene ½ zinc chloride |

-continued

| Example | |
|---|---|
| 77 | 1-diazo-2,5-dibutoxy-4-morpholino benzene sulfate |
| 78 | 1-diazo-2,5-diethoxy-4-morpholino benzene ½ zinc chloride |
| 79 | 1-diazo-2,5-dimethoxy-4-morpholino benzene zinc chloride |
| 80 | 4-diazo-2,5-dimethoxy phenyl morpholino zinc chloride |
| 81 | 1-diazo-2,5-diethoxy-4-morpholino benzene borofluoride |
| 82 | 4-diazo-2,5-dibutoxy phenyl morpholino borofluoride |
| 83 | 2,5-di-n-butoxy-4-morpholino benzene diazonium chloride ½ zinc chloride |
| 84 | 1-diazo-4-N—methyl-N—hydroxyethyl aniline ½ zinc chloride |
| 85 | 1-diazo-4-N,N—dimethyl aniline borofluoride |
| 86 | 1-diazo-2-ethoxy-4-N,N—diethyl aniline zinc chloride |
| 87 | 1-diazo-4-N,N—dimethyl aniline ½ zinc chloride |
| 88 | 4-diazo-1-dimethyl aniline zinc chloride |
| 89 | 4-diazo-1-diethyl aniline zinc chloride |
| 90 | diphenylamine-4-diazonium borofluoride |
| 91 | (condensation product) diphenylamine-4-diazonium chloride ½ zinc chloride + formaldehyde |
| 92 | (condensation product) p-diazo diphenylamine chloride zinc chloride + formaldehyde |
| 93 | (condensation product) diphenylamine-4-diazonium tri-isopropyl naphthalene sulfonate + formaldehyde |
| 94 | (condensation product) 4-diazo diphenylamine sulfate + formaldehyde |
| 95 | p-nitrobenzene diazonium borofluoride |
| 96 | 1-diazo-4-benzoyl amino-2,5-diethoxy benzene ½ zinc chloride |
| 97 | 2,5-diethoxy-4-(p-tolyethio)benzene diazonium chloride ½ zinc chloride |

All of the diazonium salts proved useful in producing an image except p-nitrobenzene diazonium borofluoride which was very unstable and reacted prematurely in solution. Tests including diphenylamine-4-diazonium borofluoride (DDBF), 1-diazo-2,5-diethoxy-4-morpholino benzene borofluoride and 2,5-diethoxy-4-(p-tolyethio)benzene diazonium chloride ½ zinc chloride gave the highest Dmax values but the ΔDensity values were not improved due to correspondingly higher Dmin values.

EXAMPLES 98–127

A study was made of the most effective compounds from previous examples. A diazo solution containing 2.5 g DDBF (diphenylamine-4-diazonium borofluoride) and 22.5 g of 50% methanol/50% acetone was prepared. Also Master Batch #1 (1.6 g leuco crystal violet, 14.4 g toluene and 48.0 g of a solution containing 40% VC-VA-87/13-2 dissolved in 10% MIBK/50% MEK) and Master Batch #2 (0.8 g leuco crystal violet, 15.2 g toluene, and 48.0 g of solution containing 40% VC-VA-87/13-2 dissolved in 10% MIBK/50% MEK) were prepared. The materials listed below were also tested using 1.0 g diazo solution in 4.0 g Master Batch #1, and they were tested using 0.5 g diazo solution in 4.0 g Master Batch #2.

| Example | |
|---|---|
| 98,99 | phthalic acid |
| 100,101 | nitric acid |
| 102,103 | ascorbic acid |
| 104,105 | TCCI |
| 106,107 | tetrachloro phthalic anhydride |
| 108,109 | Phenidone A |

-continued

| Example | |
|---|---|
| 110,111 | catechol |
| 112,113 | 2,2'-methylenebis (4-methyl-6-tert butylphenol) |
| 114,115 | 2,6-bis(2'-hydroxy-3'-tert butyl-5'-methylbenzyl)-4-methylphenol |
| 116,117 | TBHDM |
| 118,119 | $Mg(ClO_4)_2$ |
| 120,121 | $Mg(NO_3)_2.6H_2O$ |
| 122,123 | $MgBr_2.6H_2O$ |
| 124,125 | Benzoyl Peroxide |
| 126,127 | Aromatic polyketone resin (Mohawk Industries MR-85) |

1,1,2-trimethyl-5-carboxyl-3-(p-carboxyphenyl)indan (TCCI) and TBHDM were found to be effective in reducing the Dmin and thereby increasing the ΔDensity values to some extent.

EXAMPLES 128–129

Anylsis of formulations containing variable amounts of Phenidone A, phthalic acid, 1:1 DDMBB and DDBF, leuco crystal violet, TCCI, ascorbic acid, and a solution of 40% VC-VA-87/13-2 dissolved in 10% MIBK/50% MEK, in addition to solvents, was made. The best results were obtained from formulations of examples 128 and 129, shown below in Table 3.

TABLE 3

| | Examples No. 128 and 129 in g | |
|---|---|---|
| | 128 | 129 |
| phthalic acid | 0.10 | 0.20 |
| DDMBB/DDBF | 0.075 | 0.075 |
| acetone | 0.875 | 0.775 |
| LCV | 0.075 | 0.075 |
| TCCI | 0.100 | 0.100 |
| THF | 0.825 | 0.825 |
| 40% VC-VA-87/13-2 (10% MIBK/50% MEK) | 4.0 | 4.0 |
| Initial Density | 0.18 | 0.04 |
| LS (Dmin) | 0.30 | 0.17 |
| NSL (Dmax) | 1.30 | 1.06 |
| Density | 1.0 | 0.89 |

EXAMPLES 130–139

These examples examine variations of the "best formulations" from the previous tests. Results are tabulated in Table 4. Initial density ($D_I$) refers to the optical density of the coating before exposure to light and heat and as noted previously Dmin refers to the optical density of the light struck areas after exposure to light and heat and Dmax refers to the optical density of the non-light struck area after exposure to light and heat.

TABLE 4

| | COMPONENTS(g) 40% VC-VA 87/13-2 | | | | | | | | | |
|---|---|---|---|---|---|---|---|---|---|---|
| Example | LCV | TCCI | Phen A | THF | 10% MIBK 50% acetone | phthalic acid | DDMBB | DDMBS** | 1:1 methanol acetone | 1:1 methanol acetone |
| 130 | .125 | .150 | — | 1.725 | 4.0 | .100 | .125 | — | 1.775 | — |
| 131 | .100 | .100 | — | 1.800 | 4.0 | — | — | .100 | .900 | — |
| 132 | .100 | — | .010 | 1.890 | 4.0 | — | — | .100 | .900 | — |
| 133[1,4] | .100 | — | — | 1.890 | 4.0 | — | — | .100 | .900 | — |
| 134 | .125 | .150 | .010 | 1.715 | 4.0 | .100 | .125 | — | 1.775 | — |
| 135[2] | .125 | .150 | — | 1.675 | 4.0 | .100 | .125 | — | 1.775 | — |
| 136[2] | .125 | .150 | .005 | 1.670 | 4.0 | .150 | .125 | — | — | 1.725 |
| 137[2,3] | .125 | .150 | .005 | 1.670 | 4.0 | .150 | — | — | — | 1.725 |
| 138[2] | .125 | .150 | .005 | 1.670 | 4.0* | .150 | .125 | — | — | 0.725 |
| 139[2] | .125 | .150 | .005 | 1.670 | 4.0* | .150 | — | .125 | — | .725 |

| | | Optical Densities | | | |
|---|---|---|---|---|---|
| Example | Coating (mils) | $D_I$ | $D_{MIN}$ | $D_{MAX}$ | ΔDensity |
| 130 | 3.2 | .12 | .39 | 1.55 | 1.16 |
| 131 | 2.8 | .15 | .30 | 1.30 | 1.00 |
| 132 | 2.8 | .13 | .24 | .66 | .42 |
| 133 | 3.2 | .33 | .36 | .57 | .21 |
| 134 | 3.2 | .17 | .33 | 1.12 | .79 |
| 135 | 3.2 | .12 | .40 | 1.42 | 1.02 |
| 136 | 3.2 | .12 | .28 | 1.15 | .87 |
| 137 | 3.2 | .28 | .44 | 1.30 | .86 |
| 138 | 2.8 | .13 | .29 | 1.23 | .94 |
| 139 | 2.8 | precipitate formed-discarded | | | |

[1]Formulation included .010g Ascorbic acid
[2]Formulation included .050g Catechol
[3]Formulation included .125g DDBF
[4]Formulation included 1.000g Methanol
*Resin solution was added to diazo solution rather than LCV solution
**1-diazo-2,5-dibutoxy-4-morpholino benzene sulfate Examples 130, 131, 135 and 139 gave borderline commercial results, the ΔDensity values being respectively 1.16, 1.00, 1.02 and 0.94. The resolution in these cases is excellent, being in the order of 400 line pairs per mm.

Additional experiments were run to test the effects upon the image produced by varying leuco dyes in the formulations. Leuco crystal violet and leuco malechite green were the most effective dyes in the practice of this invention. All the dyes tested and listed below were found to have utility in the present invention but the formulations must be optimized to make a useful product.

(1) Leuco Crystal Violet

-continued

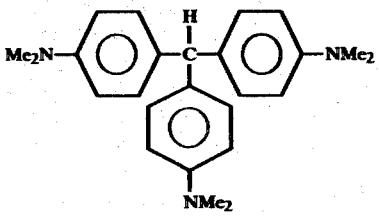

4,4',4"-methylidynetris-(N,N—dimethylaniline)

(2) Leuco Malachite Green

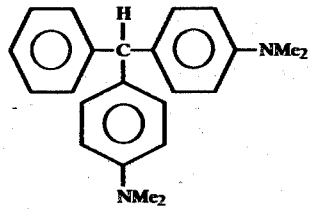

p-p'benzylidenebis-(N,N—dimethylaniline)

(3) Copichem II

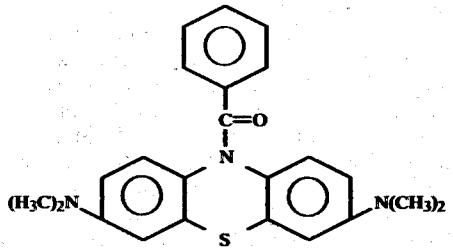

leuco form (4) Leuco Atacryl Orange-LGM: Color Index Basic Orange 21, Comp.

48035 (a Fischer's base type compound)

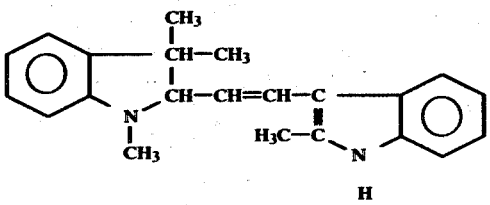

(5) Leuco Atacryl Brilliant Red-4G:

Color Index Basic Red 14

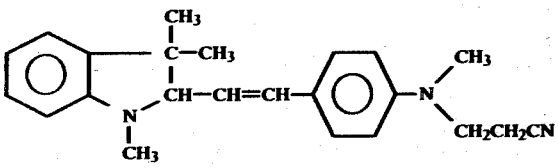

(6) Leuco Ethyl Violet:

-continued

Color Index Basic Violet 4, comp. #42600

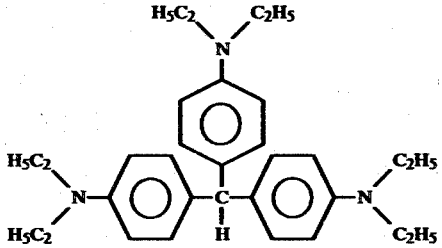

(7) Leuco Victoria Blue-BGO:

Color Index Basic Blue 728a, comp. #44040

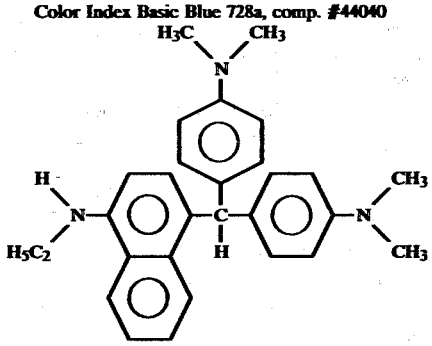

(8) Leuco Atacryl Yellow-R:

Color Index Basic Yellow 11, Comp. #48055

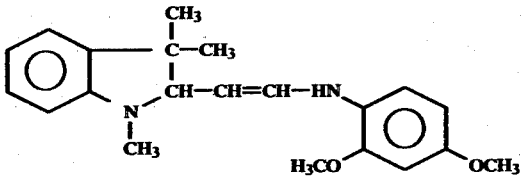

(9) Leuco Atlantic Fuchsine Crude:

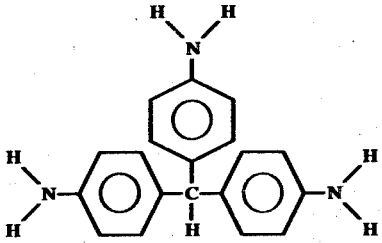

What is claimed:

1. An article comprising a light sensitive, positive-acting, heat developable, dry layer on a substrate, the dry ingredients of said layer comprising at least 25% by weight of a polymeric binder, at least 0.3% by weight of a leuco dye capable of being oxidized to a colored form upon only heating, a sufficient amount of a photosensitive diazonium salt to oxidize said leuco dye to a colored form in non-light struck portions of said layer, and less than 0.1 mole nitrate ion per 1.0 mole leuco dye, said leuco dye in said layer being present in a concentration sufficient to provide an increase in optical density upon development of at least 0.2.

2. The article of claim 1 wherein said leuco dye in said layer is present as at least 1% by weight of dry ingredients of said layer.

3. The article of claim 1 wherein said leuco dye in said layer is present in the amount of 2% to 10% by weight of dry ingredients of said layer.

4. The article of claim 1 wherein said leuco dye in said layer is present in a concentration sufficient to provide an increase in optical density upon development of at least 0.6.

5. The article of claim 1 wherein said leuco dye in said layer is present in a concentration sufficient to provide an increase in optical density upon development of at least 1.0.

6. The article of claim 1 wherein said leuco dye in said layer is selected from the class consisting of leuco crystal violet and leuco malechite green.

7. The article according to claim 1 wherein said layer comprises the diazonium salt 1-diazo-2,5-diethoxy-4-morpholino benzene borofluoride.

8. The article according to claim 1 wherein the development temperature of said layer is between 180° F. (82° C.) and 380° F. (193° C.).

9. The article according to claim 1 wherein the development temperature of said layer is between 220° F. (105° C.) and 350° F. (167° C.).

10. The article according to claim 1 wherein said binder in said layer is selected from the class consisting of polyvinyl chloride and polyvinyl acetate resins.

11. The article according to claim 10 wherein said binder in said layer is present as at least 25% by weight of dry ingredients in the layer.

12. The article according to claim 10 wherein said binder in said layer is present as at least 50% by weight of dry ingredients in the layer.

13. The article according to claim 10 wherein said binder in said layer is present as at least 70% by weight of dry ingredients in the layer.

14. An article comprising a light sensitive, positive-acting, heat developable, dry layer on a substrate, the dry ingredients of said layer consisting essentially of at least 25% by weight of a polymeric binder, at least 0.3% by weight of a leuco dye capable of being oxidized upon only heating to a colored form, a sufficient amount of a photosensitive diazonium salt to oxidize said leuco dye to a colored form in non-light struck portions of said layer, and less than 0.1 mole nitrate ion per 1.0 mole leuco dye, said leuco dye in said layer being present in a concentration sufficient to provide an increase in optical density upon development of at least 0.2.

15. The article according to claim 14 wherein said layer further consists of an amount of phenidone sufficient to depress the Dmin value of said layer.

16. An article comprising a light sensitive, positive-acting, heat developable, dry layer on a substrate, the dry ingredients of said layer consisting of at least 25% by weight of a polymeric binder, at least 0.3% by weight of a leuco dye capable of being oxidized upon only heating to a colored form, a sufficient amount of a photo-sensitive diazonium salt to oxidize said leuco dye to a colored form in non-light struck portions of said layer, and less than 0.1 mole nitrate ion per 1.0 mole leuco dye, said leuco dye in said layer being present in a concentration sufficient to provide an increase in optical density upon development of at least 0.2.

17. An article comprising a light sensitive, positive-acting, heat developable, dry layer on a substrate, the dry ingredients of said layer consisting of at least 25% by weight of a polymeric binder, at least 0.3% by weight of a leuco dye capable of being oxidized upon only heating to a colored form, a sufficient amount of a photosensitive diazonium salt to oxidize said leuco dye to a colored form in non-light struck portions of said layer, a chemically effective amount of at least one additive selected from antioxidants, complexors, plasticizers, polyketones, stabilizers, surfactants, antistatic agents, coating aids, inhibitors, lubricants, flexibilizers, and fillers, and less than 0.1 mole nitrate ion per 1.0 mole leuco dye, said leuco dye in said layer being present in a concentration sufficient to provide an increase in optical density upon development of at least 0.2.

18. A process for imaging an article comprising a light sensitive, positive-acting, heat developable, dry layer on a substrate, the dry ingredients of said layer comprising at least 25% by weight of a polymeric binder, at least 0.3% by weight of a leuco dye capable of being oxidized to a colored form upon only heating, a sufficient amount of a photosensitive diazonium salt to oxidize said leuco dye to a colored form in non-light struck portions of said layer, and less than 0.1 mole nitrate ion per 1.0 mole leuco dye, said leuco dye in said layer being present in a concentration sufficient to provide an increase in optical density upon development of at least 0.2, said process comprising the steps:

a. exposing said article to an image-wise distribution of radiation to destroy said diazonium salt in light-struck areas, and b. heating said article to enable said diazonium salt to oxidize said leuco dye to a colored form in non light-struck areas to produce said positive image.

* * * * *